US005968882A

United States Patent [19]

Matsuhisa et al.

[11] Patent Number: 5,968,882

[45] Date of Patent: Oct. 19, 1999

[54] MIXED SOLVENT COMPOSITION, AND CLEANING METHOD AND CLEANING APPARATUS USING THE SAME

[75] Inventors: Hirohide Matsuhisa, Yokohama; Tomomasa Nakamura, Kawasaki, both of Japan

[73] Assignee: Canon Kabushiki Kaisha, Tokyo, Japan

[21] Appl. No.: 08/529,085

[22] Filed: Sep. 15, 1995

[30] Foreign Application Priority Data

Sep. 22, 1994 [JP] Japan ..... 6-252742

[51] Int. Cl.[6] ..... C11D 7/30

[52] U.S. Cl. ..... 510/245; 510/256; 510/365; 510/407; 510/410; 510/412

[58] Field of Search ..... 510/245, 256, 510/365, 407, 410, 412; 252/67

[56] References Cited

U.S. PATENT DOCUMENTS

| | | | |
|---|---|---|---|
| 3,511,760 | 5/1970 | Fox et al. | 2104/59 |
| 4,092,257 | 5/1978 | Fozzard | 252/66 |
| 5,304,322 | 4/1994 | Kuse | 134/42 |
| 5,403,514 | 4/1995 | Matsuhisa et al. | 252/364 |
| 5,474,695 | 12/1995 | Macaudiere et al. . | |

FOREIGN PATENT DOCUMENTS

| | | | |
|---|---|---|---|
| 0465037 | 1/1992 | European Pat. Off. | G03G 11/00 |
| 4-363381 | 12/1992 | Japan | C09K 3/00 |
| 05214324 | 8/1993 | Japan . | |
| 7-48563 | 2/1995 | Japan . | |
| 7048563 | 2/1995 | Japan . | |

*Primary Examiner*—Margaret Einsmann
*Attorney, Agent, or Firm*—Fitzpatrick, Cella, Harper & Scinto

[57] ABSTRACT

Disclosed herein is a nonflammable mixed solvent composition comprising a completely fluorinated organic compound and a partially fluorinated organic compound as essential components, wherein the completely fluorinated organic compound is contained in an amount of at least 5% by weight.

8 Claims, 4 Drawing Sheets

MIXED SOLVENT COMPOSITION, AND CLEANING METHOD AND CLEANING APPARATUS USING THE SAME

BACKGROUND OF THE INVENTION

1. Field of the Invention

The present invention relates to a novel non-flammable mixed solvent composition, and a cleaning method and a cleaning apparatus using such a solvent composition, and further particularly to a novel nonflammable mixed solvent composition which is replaceable for organochlorine solvents including 1,1,2-trichloro-1,2,2-trifluoroethane (hereinafter abbreviated as "flon 113") and 1,1,1-trichloroethane (hereinafter abbreviated as "triethane") and has excellent properties, in particular, as a cleaning solvent and a vapor drying solvent (vapor cleaning and drying solvent), and a cleaning method using such a solvent and a cleaning apparatus for performing the cleaning method.

2. Related Background Art

Chlorofluorocarbons (hereinafter abbreviated as "CFC") have heretofore been used in many industrial fields because most of them are low in toxicity, incombustible and chemically stable, and various kinds of flons different in boiling point are available.

Among these, flon 113 has been used as a degreasing solvent or vapor drying solvent for many plastic materials, a part of rubber materials and various composite materials, making good use of specific chemical properties inherent in the solvent.

The reason why flon 113 has heretofore been often used as a vapor drying solvent is that it has the following properties:

a) to have moderate dissolvability for various kinds of dirt and oils;

b) to have excellent chemical and thermal stability, and so there is little fear of decomposition;

c) to be low in toxicity and have neither flash point nor ignition point, and hence be high in operational safety;

d) to be low in polarity and hence cause no damage to various kinds of plastic materials; and e) to have a sufficiently low surface tension and hence wet the surface of a substance to be cleaned to thinly and evenly spread thereon.

Therefore, in order to replace flon 113, a replacement is also required to have the same properties as described above.

At present, hydrochlorofluorocarbons such as 1,1-dichloro-2,2,2-trifluoroethane (hereinafter abbreviated as "HCFC123"), 1-fluoro-1,1-dichloroethane (hereinafter abbreviated as "HCFC141b"), 1,1-dichloro-2,2,3,3,3-pentafluoropropane (hereinafter abbreviated as "HCFC225ca") and 1,3-dichloro-1,1,2,2,3-pentafluoropropane (hereinafter abbreviated as "HCFC225cb") have been developed as second-generation flons and are under investigation as to whether they can be used as replacements or not.

However, these second-generation flons are high in dissolvability for various kinds of oils and fats, but most of them attack general-purpose plastics such as acrylic resins and ABS resins and besides, they are high in ozone depletion potential because they contain chlorine in their molecules. Therefore, they are not of serious consideration as replacements.

Besides, triethane has been used as a replacement for trichloroethylene and tetrachloroethylene, which have hitherto been used as degreasing and cleaning solvents for metal surfaces after metal working, are noxious to the human body and form the cause of pollution of underground water.

The reason why triethane has been used is that it has the following properties:

a) to have strong detergency to metalworking oils;

b) to be low in toxicity and have neither flash point nor ignition point, and hence be high in operational safety; and c) to cause no damage to metals to be cleaned because it has no water-solubility and hence contains no water therein (namely, low in possibility that it may oxidize and corrode the metals).

At present, methylene chloride (dichloromethane) and various petroleum cleaning solvents have been studied as replacements for triethane. However, no replacement well balanced among all the aspects of safety (toxicity, carcinogenesis, flammability, etc.), detergency and drying characteristics has been yet developed.

A method in which only a completely fluorinated organic compound is used as a vapor drying solvent is also studied in a semiconductor-fabricating process and the like. However, completely fluorinated organic compounds involve a problem that since they have no degreasing ability, a stain tends to occur on the surface of an article cleaned unless the article is completely degreased prior to this cleaning step.

The completely fluorinated organic compounds exhibit specific dissolution behavior that they are miscible only with some limited solvents. Therefore, they involve a problem that a stain after drying tends to occur because a solvent and water used for degreasing in a preceding step cannot be purged with ease.

In recent years, ozone holes by which global environment is made worse have been discovered, and the main cause that the ozone hole is created has been proved to be attributable to organochlorine compounds.

For example, flon 113, which is chemically stable, lasts long in the troposphere, diffuses to the stratosphere and is photochemically decomposed by sunrays there, thereby generating chlorine radicals which then combine to ozone so as to destroy the ozonosphere. Therefore, after this, the organochlorine compounds including flons have a tendency for their use to be internationally limited or prohibited.

Among these, flon 113 as described above is high in ozone depletion potential. Thus, flon 113 is desired to be early replaced with proper one, and has a schedule for unsparingly reducing its use. Triethane and other organochlorine solvents are also scheduled to be unsparingly reduced for the same reason as described above.

SUMMARY OF THE INVENTION

It is thus an object of the present invention to provide a nonflammable mixed solvent composition which is a novel cleaning solvent replaceable for flon 113 and triethane which are organochlorine solvents routinely used in such a background, and a cleaning method and a cleaning apparatus using such a solvent composition.

The above object can be achieved by the present invention described below.

In an aspect of the present invention, there is thus provided a nonflammable mixed solvent composition comprising a completely fluorinated organic compound and a partially fluorinated organic compound as essential components, wherein the completely fluorinated organic compound is contained in an amount of at least 5% by weight.

In another aspect of the present invention, there is also provided a nonflammable mixed solvent composition comprising 5 to 35% by weight of a completely fluorinated organic compound, 20 to 65% by weight of a partially fluorinated organic compound and 0 to 47.5% by weight of unhalogenated organic compound.

In a further aspect of the present invention, there is provided a method of cleaning an article, which comprises using the nonflammable mixed solvent composition according to any one of the above aspects at least once.

In still a further aspect of the present invention, there is provided a cleaning apparatus comprising at least one cleaning tank and a device for feeding the nonflammable mixed solvent composition according to any one of the above aspects to the cleaning tank.

DESCRIPTION OF THE PREFERRED EMBODIMENTS

Figures 1A, 1B, 1C:
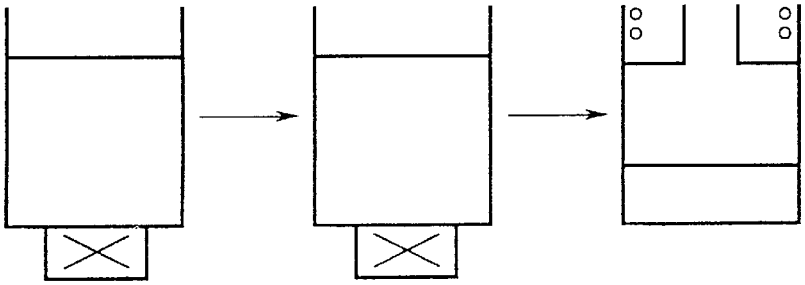
FIGS. 1A through 1C illustrate a cleaning apparatus and a cleaning method according to an embodiment of the present invention.
Figures 2A, 2B, 2C, 2D, 2E:
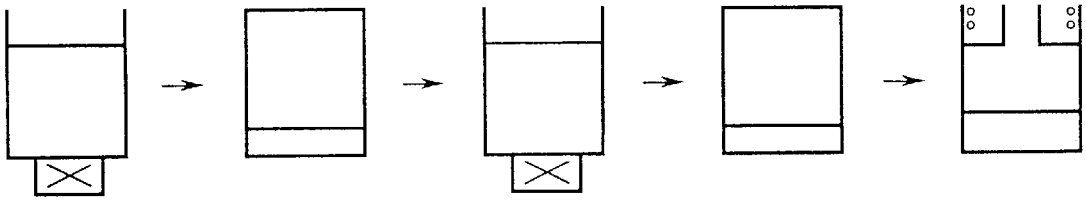
FIGS. 2A through 2E illustrate a cleaning apparatus and a cleaning method according to another embodiment of the present invention.
Figures 3A, 3B, 3C, 3D, 3E:
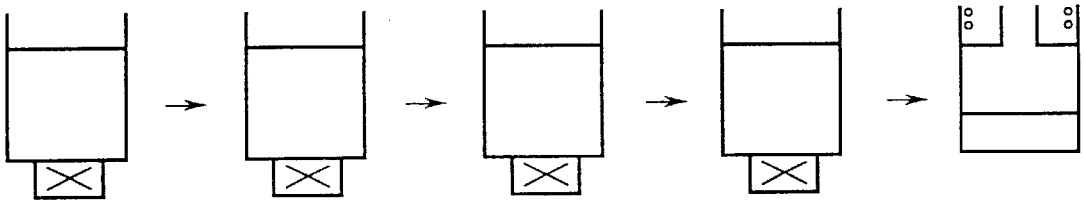
FIGS. 3A through 3E illustrate a cleaning apparatus and a cleaning method according to a further embodiment of the present invention.

The present inventors have paid attention to the tendency to scarcely make chemical attack and incombustibility of completely fluorinated organic compounds and carried out an investigation as to making incombustible, mixed solvent systems composed of the completely fluorinated organic compound and various kinds of other organic solvents. As a result, these mixed solvent compositions have been judged not to draw in a test flame in a Tag closed flash point test and hence to have no flash point. However, the test flame in the closed flash point test has been observed enlarging. Therefore, these compositions have been unable to be judged to be incombustible. The present inventors have carried out a further investigation with a view toward making mixed solvent systems of the completely fluorinated organic compound and various kinds of other organic solvents completely incombustible. As a result, the present invention has been led to completion.

The present invention will hereinafter be described in detail by preferred embodiments.

A nonflammable mixed solvent composition according to the present invention comprises a completely fluorinated organic compound, which has no flash point and is chemically stable, an unhalogenated organic compound high in degreasing and cleaning ability, and a partially fluorinated organic compound which exhibits good solubility in both organic compounds.

More particularly, the nonflammable mixed solvent composition according to the present invention is composed of not less than 5% by weight, preferably 5 to 35% by weight of the completely fluorinated organic compound and 20 to 65% by weight of the partially fluorinated organic compound as essential components, and optionally 0 to 47.5% by weight of the unhalogenated organic compound.

If the content of the completely fluorinated organic compound is lower than the lower limit of the above range, the resulting composition is difficult to retain incombustibility. On the other hand, any content higher than the upper limit of the above range results in an unstable composition exhibiting a high phase separation temperature. In any event, such a composition is difficult to retain incombustibility.

If the content of the partially fluorinated organic compound is lower than the lower limit of the above range, the resulting composition also becomes unstable, exhibits a high phase separation temperature and is difficult to retain incombustibility.

The content of the unhalogenated organic compound offers no problem at the lowest so far as it is within a range satisfying the degreasing and cleaning ability. However, if the content is too high, the resulting composition becomes unstable, exhibits a high phase separation temperature and is difficult to retain incombustibility.

With respect to the proportion of the unhalogenated organic compound to the partially fluorinated organic compound contained in the composition, it is preferable to use the partially fluorinated organic compound in a greater amount. On the other hand, if the unhalogenated organic compound is used in a greater amount, the resulting composition becomes unstable, exhibits a high phase separation temperature and is difficult to retain incombustibility.

In the mixed solvent composition composed of the completely fluorinated organic compound, the partially fluorinated organic compound and the unhalogenated organic compound, it is preferable to satisfy a relationship of (weight fraction of the partially fluorinated organic compound)≧(weight fraction of the unhalogenated organic compound). If this relationship is reverse, the amount of the partially fluorinated organic compound is too small, and so there is a possibility that the resulting mixed solvent composition may become flammable. Such a low value is hence not preferable.

As the completely fluorinated organic compound useful in the practice of the present invention, there may be used various kinds of known compounds such as various perfluorocarbons, perfluoro ethers and perfluoroamines. Those having a vapor pressure of 5.33 kPa or higher at 25° C. are preferred. Any completely fluorinated organic compound low in vapor pressure results in a flammable mixed solvent composition.

Specific examples of the completely fluorinated organic compound include perfluorocarbons such as perfluoropentane, perfluorohexane, perfluoroheptane and perfluorooctane. These solvents are commercially available under the following trade names:

Fluorinert FC-87, 72, 84 and 75;

Inert Fluid PF-5050, 5060, 5070 and 5080;

Perfluorocarbon Coolant FX3250, 3300 and 3252 (the foregoing are products of Sumitomo 3M Limited); and F Lead KPF-61, 72 and 82 (products of Kanto Denka Kogyo Co., Ltd.).

Perfluoro ethers such as perfluoro-2-butyltetrahydrofuran and hexafluoropropene oxide oligomer derivatives are commercially available under the following trade names:

Fluorinert FC-77 (product of Sumitomo 3M limited); and

GALDEN SV-70, 90 and 110 (products of Montecatini).

Perfluoro nitrogen-containing compounds such as perfluoro-4-methylmorpholine and perfluorotriethylamine are commercially available under the following trade names:

Inert Fluid PF-5052 (product of Sumitomo 3M Limited); and

Perflode S-210 (product of Tokuyama Soda Co., Ltd.).

The above solvents are examples, and the present invention is thus not limited to these solvents.

The partially fluorinated organic compound useful in the practice of the present invention is selected from the group consisting of compounds which exhibit good solubility in both completely fluorinated organic compounds and unhalogenated organic compounds.

As a result that the correlation in compatibility between this partially fluorinated organic compound as the second component and other solvents has been studied, a compound having a degree of substitution by fluorine [DS.(F)] of 0.35 to 0.85 (inclusive) is preferred as the partially fluorinated organic compound. If the content of fluorine is too low or high, the individual components do not form a compatible system, or the resulting composition becomes unstable, high in phase separation temperature and difficult to use even if the compatible system is formed.

Here, suppose the molecular formula of the partially fluorinated organic compound is represented by $C_aH_bF_cX_d$, in which X is a heteroatom as a constituent for the organic compound selected from the group consisting of O, N, S, P and Si, a, b and c are independently a natural number, and d is an integer not smaller than 0, the degree of substitution by fluorine [DS.(F)] is defined by the following equation:

$$DS.(F)=c/(b+c).$$

If the boiling point of the partially fluorinated organic compound is too low, the resulting composition becomes sharp in change of composition and hence difficult to use and moreover may turn flammable. On the other hand, if the boiling point is too high, the resulting composition becomes poor in drying ability and hence difficult to completely dry by any process other than vapor drying. Therefore, a partially fluorinated organic compound having a boiling point not lower than 60° C. but lower than 120° C. is preferably used.

If a compound also containing a halogen atom other than fluorine is used as the partially fluorinated organic compound, the resulting composition lacks stability to heat and light. It is hence not preferable to use such a compound.

Specific examples of partially fluorinated compounds satisfying such conditions include 1,3-bis(trifluoromethyl) benzene and 1,4-bis(trifluoromethyl)benzene (products of Tokyo Kasei Kogyo Co., Ltd.); MTF-TFM and PTF-TFM (trade names, products of Central Glass Co., Ltd.); benzotrifluoride (product of Wako Pure Chemical Industries, Ltd.); pentafluorobenzene (product of Tokyo Kasei Kogyo Co., Ltd.); ethyl trifluoroacetate and isopropyl trifluoroacetate (products of PCR); trifluoroethanol (product of Tokyo Kasei Kogyo Co., Ltd.); and pentafluoropropanol (product of Daikin Industries, Ltd.). However, the present invention is not limited to these compounds.

The unhalogenated organic solvent further used in the present invention is preferably a solvent high in flash point with a view toward providing a composition having neither flash point nor fire point. In order to provide a composition retaining good drying ability on the other hand, a solvent high in vapor pressure and low in boiling point is preferred. Such a solvent is usually low in flash point. As described above, the unhalogenated organic compound in the composition according to the present invention preferably has a flash point not lower than 0° C. but lower than 70° C. in order to satisfy the conflicting conditions.

As the unhalogenated organic compound used in the present invention, any organic compound may be used so far as it is an organic compound containing none of halogen atoms such as fluorine and chlorine atoms, and its flash point falls within a range of from 0° C. (inclusive) to 70° C. (exclusive).

Specific examples of such an unhalogenated organic compound include oxygen-containing compounds such as ethers, esters, alcohols and ketones; aromatic hydrocarbons such as toluene, xylene, tert-butylbenzene and tert-amylbenzene; alicyclic hydrocarbons (naphthenes) such as cyclohexane; aliphatic hydrocarbons (isoparaffins and normal paraffins); and mixtures of the above various compounds. Isoparaffins are particularly preferred because of their high compatibility with the completely fluorinated organic compounds.

Hydrocarbon solvents composed of one of these paraffins, naphthenes or aromatic hydrocarbons, or a mixture thereof are commercially available under, for example, the following trade names:

Isosol, Naphthesol and Hi-Sol (products of Nippon Petrochemicals Co., Ltd.);

Kyowasol (product of Kyowa Hakko Kogyo Co., Ltd.);

ACTREL (product of Exxon Chemical Japan Ltd.);

NS Clean (product of Nikko Sekiyu Kagaku K.K.); and

DAPHNE Cleaner (product of Idemitsu Kosan Co., Ltd.).

The nonflammable mixed solvent compositions according to the present invention, which are composed respectively of the above-described components and compositions, are useful in cleaning various kinds of articles.

Particularly preferred combinations in the mixed solvent compositions according to an embodiment of the present invention are as follows:

Perfluorohexane/1,3-bis(trifluoromethyl)benzene/isoparaffin having a flash point not lower than 25° C. but lower than 60° C.;

Perfluorohexane/1,4-bis(trifluoromethyl)benzene/isoparaffin having a flash point not lower than 25° C. but lower than 60° C.;

Perfluorohexane/a mixture of 1,3-bis(trifluoromethyl) benzene and 1,4-bis(trifluoromethyl)benzene/isoparaffin having a flash point not lower than 25° C. but lower than 60° C.;

Perfluorohexane/1,3-bis(trifluoromethyl)benzene/naphthene having a flash point not lower than 25° C. but lower than 60° C.;

Perfluorohexane/1,4-bis(trifluoromethyl)benzene/naphthene having a flash point not lower than 25° C. but lower than 60° C.;

Perfluorohexane/a mixture of 1,3-bis(trifluoromethyl) benzene and 1,4-bis(trifluoromethyl)benzene/naphthene having a flash point not lower than 25° C. but lower than 60° C.;

Perfluorohexane/1,3-bis(trifluoromethyl)benzene/a mixture of isoparaffin and naphthene, both, having a flash point not lower than 25° C. but lower than 60° C.;

Perfluorohexane/1,4-bis(trifluoromethyl)benzene/a mixture of isoparaffin and naphthene, both, having a flash point not lower than 25° C. but lower than 60° C.; and Perfluorohexane/a mixture of 1,3-bis(trifluoromethyl) benzene and 1,4-bis(trifluoromethyl)benzene/a mixture of isoparaffin and naphthene, both, having a flash point not lower than 25° C. but lower than 60° C.

The cleaning method according to the present invention features that the nonflammable mixed solvent composition of the present invention is used at least once. More specifically, a routine cleaning process includes, in addition to a cleaning step, a solvent purging or rinsing step and a vapor drying step (vapor cleaning and drying step). The nonflammable mixed solvent composition according to the present invention is used at least once in at least one step of these steps. In these cleaning, solvent purging or rinsing and vapor drying steps, any other optional cleaning solvents may be used in combination according to the kinds of articles to be cleaned. However, only the nonflammable mixed solvent composition according to the present invention is preferably used in view of operational safety, liquor control and the like.

According to the cleaning method of the present invention, a stain after drying is hard to occur on the surface of an article cleaned as compared with other drying techniques such as drying by heating, spin drying and vacuum drying, and finish high in cleanliness can hence be achieved.

As drying solvents used in the vapor drying step, there have heretofore been often used chlorinated solvents such as flon 113, 1,1,1-trichloroethane, 1,1,2-trichloro-ethylene, 1,1,2,2-tetrachloroethylene and methylene chloride owing to their nonflammability from the viewpoint of safety in flameproofing.

Since these known solvents are ozone-depleting substances and/or noxious substances to the human body, however, isopropyl alcohol (hereinafter abbreviated as "IPA") and the like have been proposed as replacements for these solvents. However, IPA has a low flash point (Fp=11.7° C.) and hence involves a problem that its use is difficult from the viewpoint of safety.

Further, it has been proposed to use only a completely fluorinated organic compound as a vapor drying solvent. However, such a proposal involves a problem that since the completely fluorinated organic compound is low in compatibility with various kinds of solvents, a stain after drying tends to occur unless a solvent used just before the vapor cleaning must be carefully chosen.

On the other hand, when the nonflammable mixed solvent composition according to the present invention is used in a vapor drying tank, a stain after drying becomes hard to occur as compared with the single use of the completely fluorinated organic compound as a vapor drying solvent. In addition, if only the completely fluorinated organic compound is used in vapor drying, good finish free of any stain after drying can be achieved so far as the nonflammable mixed solvent composition according to the present invention is used just before a vapor cleaning tank.

Although the individual steps in an ordinary cleaning operation have been described above, it is most effective that in a cleaning process in which oily smear is mainly removed, for example, a degreasing process of a metalworking oil, all of a cleaning solvent, a purging or rinsing solvent and a vapor drying solvent are composed by the same nonflammable mixed solvent compositions according to the present invention.

To the cleaning step and purging or rinsing step in the method of the present invention, may also be applied any external force such as heating, ultrasonic vibration, swinging, showering, brushing, scrubbing, jetting and/or boiling.

In the present invention, the nonflammable mixed solvent composition of the present invention is vaporized in a vapor drying tank equipped with a condenser in the vapor drying step and condensed on the surface of an article to be cleaned so as to completely wash out the purging or rinsing solvent used in the preceding purging or rinsing step. Thereafter, the treated article is pulled up at such a slow speed that a vapor line is not disturbed to completely dry it.

The cleaning apparatus and cleaning methods according to embodiments of the present invention are shown in FIGS. 1A to 1C, FIGS. 2A to 2E and FIGS. 3A to 3E.

FIGS. 1A to 1C illustrate a case where a cleaning apparatus composed of one cleaning tank, one purging or rinsing tank and one vapor drying tank was used, and the nonflammable mixed solvent composition [PF5060perfluorohexane/1,3-bis(trifluoromethyl)benzene/Isosol 300=20/40/40 (by weight)] according to the present invention was used in all the tanks. Ultrasonic cleaning is conducted at 30° C. in the cleaning tank and at 20° C. in the purging or rinsing tank, and vapor drying (vapor cleaning and drying) is performed at 56 to 60° C. in the vapor drying tank.

FIGS. 2A to 2E illustrate a case where an apparatus composed of two cleaning tanks, two purging or rinsing tanks and one vapor drying tank was used. In the first cleaning tank, Clean Sol G (trade name) is used to conduct ultrasonic cleaning at 35° C., and in the second cleaning tank, shower cleaning is performed at 20° C. using the same cleaning solution as that used in the first cleaning tank. In the first purging or rinsing tank, the nonflammable mixed solvent composition [PF5060perfluorohexane/1,3-bis(trifluoromethyl)benzene/Isosol 300=20/40/40 (by weight)] according to the present invention is used to conduct ultrasonic cleaning at 20° C., and in the second purging or rinsing tank, shower cleaning is performed at 20° C. using the same cleaning solution as that used in the first purging or rinsing tank. In the vapor drying tank, PF5060 is used to conduct vapor drying at 56–60° C.

FIGS. 3A to 3E illustrate a case where an apparatus composed of one cleaning tank, three purging or rinsing tanks and one vapor drying tank was used. In the cleaning tank, DK Beclear CW5520 (trade name) is used to conduct ultrasonic cleaning at 30° C. In the first and second purging or rinsing tanks, purified water is used to perform ultrasonic cleaning at 30° C., and in the third purging or rinsing tank, the nonflammable mixed solvent composition [PF5060/pentafluoropropanol/IPA=25/57/18 (by weight)=20/50/30 (by volume)] according to the present invention is used to conduct ultrasonic cleaning at 20° C. In the vapor drying tank, the same cleaning solution as that used in the third purging or rinsing tank is used to conduct vapor drying at 56–60° C.

Figure 5:
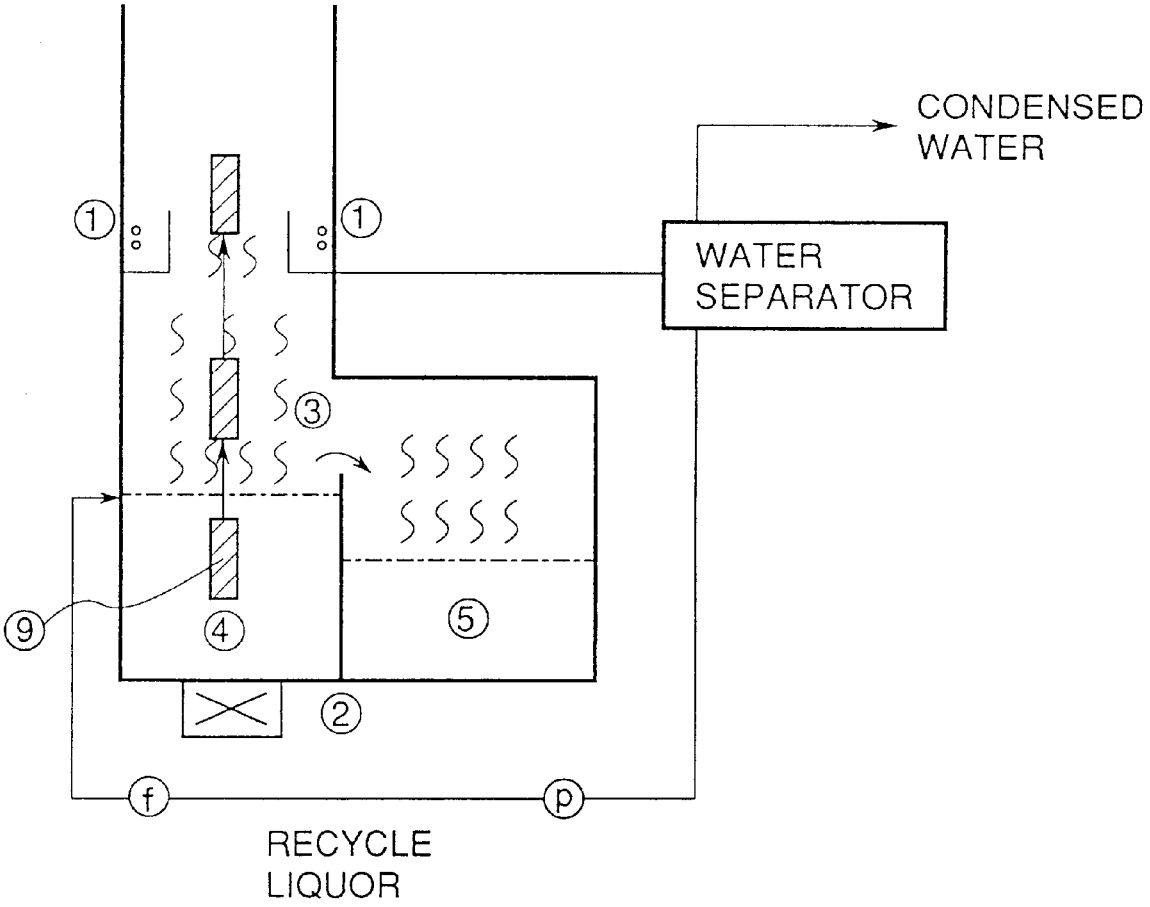
FIG. 5 illustrates a vapor drying apparatus according to an embodiment of the present invention.
Figure 6:
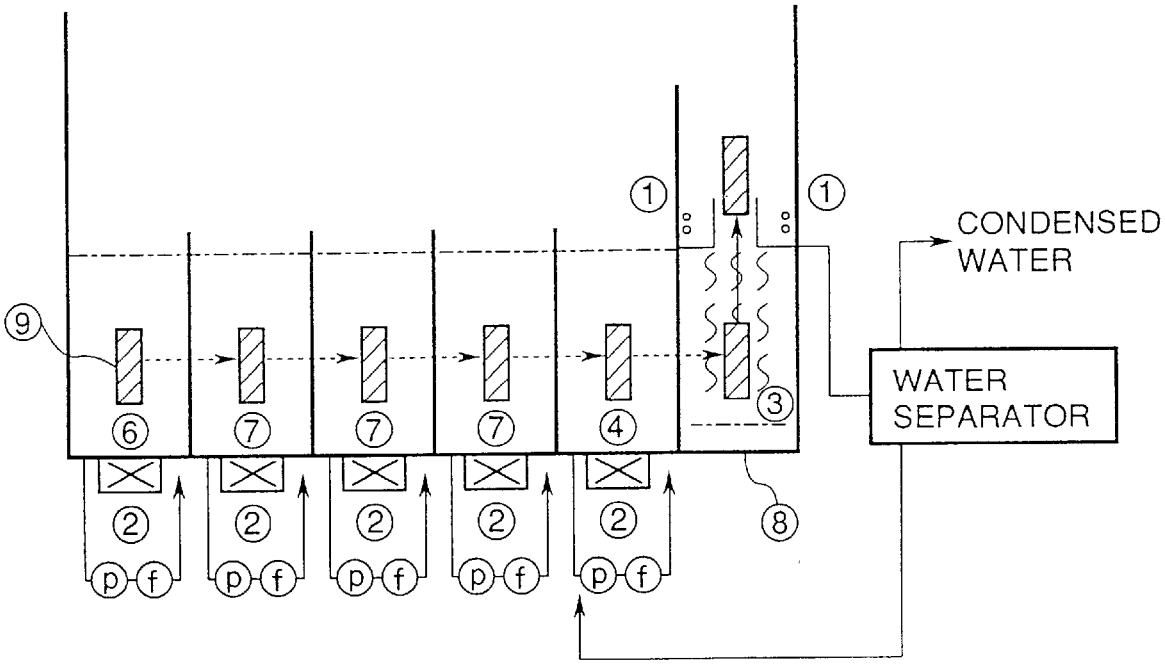
FIG. 6 illustrates a cleaning machine according to another embodiment of the present invention.

The cleaning apparatus according to the present invention in which the cleaning methods of the present invention as described above are performed comprise at least one cleaning tank and a device for feeding the nonflammable mixed solvent composition according to the present invention to the cleaning tank as illustrated in FIGS. 1A to 1C, FIGS. 2A to 2E and FIGS. 3A to 3E. The cleaning apparatus according to the present invention may further comprise in combination at least one of a solvent purging or rinsing tank and a vapor drying tank. No particular limitation is imposed on its construction so far as the apparatus meets the cleaning methods of the present invention as described above. However, since the nonflammable mixed solvent compositions according to the present invention are high in vapor pressure, it is preferable to control the freeboard ratio of the vapor drying tank high from the viewpoint of the prevention of escape of the composition by evaporation. For the same reason, the temperature of cooling water for a condenser is preferably as low as possible. More specifically, apparatus of such constructions as illustrated in FIGS. 4 through 6 by way of example are preferred.

Figure 4:
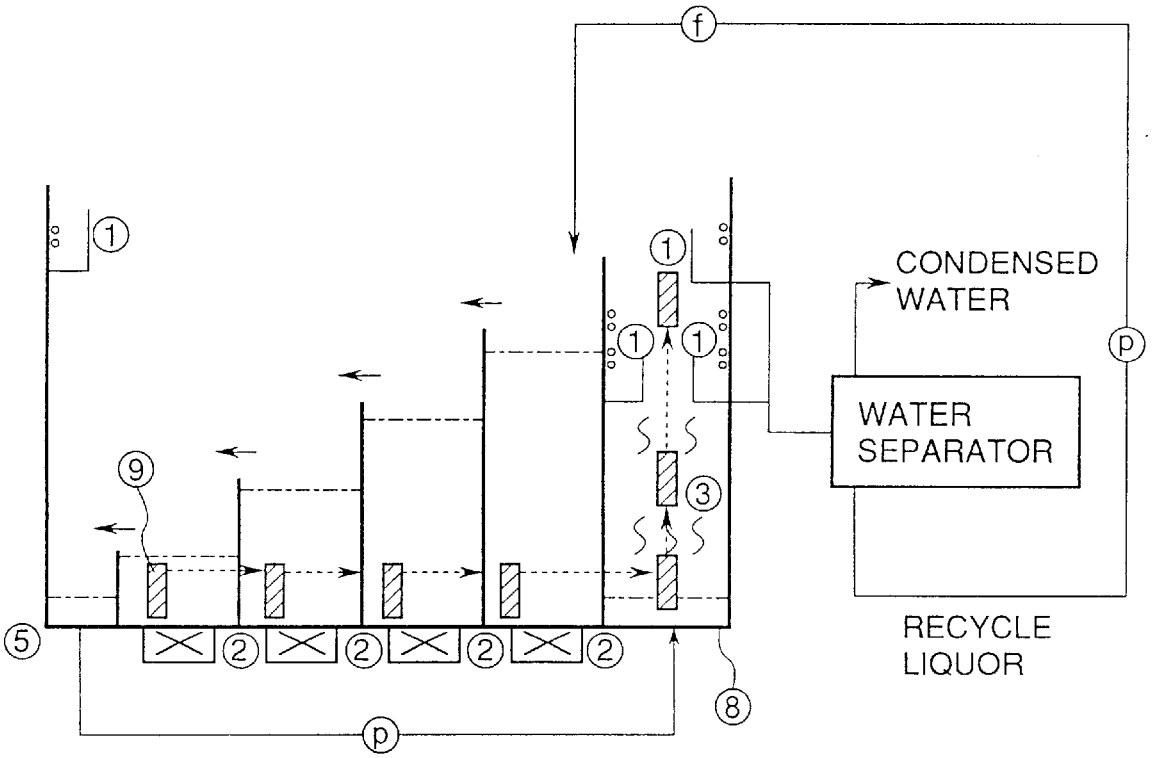
FIG. 4 illustrates a cleaning machine according to an embodiment of the present invention.

The apparatus according to the present invention illustrated in FIG. 4 is an exemplary commonly-used cleaning machine of the successive overflow tank type. Referring now to the drawing, the cleaning machine includes a plurality of ultrasonic cleaning tanks 2 which are different in height of level from each other in order and provided in lateral arrangement. In the respective ultrasonic cleaning tanks 2, are filled articles 9 to be cleaned, which are successively transferred in a right direction on the drawing. When the nonflammable mixed solvent composition 4 of the present invention fed from a feed pump P is introduced into the tank highest in level, the liquid successively overflows into the tanks lower in level, whereby the articles 9 immersed in the respective tanks 2 are subjected to ultrasonic cleaning.

A nonflammable mixed solvent composition 5 contaminated by the cleaning treatment finally overflows into the tank positioned on the leftmost side on the drawing. The contaminated nonflammable mixed solvent composition 5 is then sent by a feed pump P to a vapor drying tank 8 located on the right-hand side on the drawing. The articles 9 cleaned with the solvent and successively transferred in the right direction on the drawing are cleaned and dried with vapor 3 generated from the nonflammable contaminated mixed solvent composition 5 by vaporization and then taken out of the line.

After the vapor 3 is condensed by a condenser 1 to liquefy, water contained in the liquefied composition is separated by a water separator. The recycle liquor from which condensed water is removed is sent by the pump P through a filter f for removing dust and then fed again to the highest ultrasonic cleaning tank 2, thereby repeating this cycle.

FIG. 5 illustrates a vapor drying apparatus (vertical simple cleaning machine) according to an embodiment of the present invention. As with the embodiment of FIG. 4, the nonflammable mixed solvent composition 4 according to the present invention is sent by a pump P through a filter f to an ultrasonic cleaning tank 2 containing an article 9 to be cleaned, thereby subjecting the article 9 contained in the tank to ultrasonic cleaning. A nonflammable mixed solvent composition 5 contaminated by the cleaning of the article 9 is caused to overflow into a right-hand tank, and at the same time, the article 9 is slowly pulled up to clean and dry it with vapor 3 vaporized from the nonflammable mixed solvent compositions 4 and 5. The cleaned article is then taken out of the line.

The vapor 3 is condensed and liquefied by a condenser 1 in the same manner as the cleaning machine illustrated in FIG. 4 to reuse like the embodiment shown in FIG. 4.

FIG. 6 illustrates an exemplary cleaning machine of batch-wise successive tanks. In this case, the apparatus includes one cleaning tank 6 filled with a routine cleaning solution, three purging or rinsing tanks 7 filled with a routine purging or rinsing solvent, one cleaning tank 4 filled with the nonflammable mixed solvent composition of the present invention and one vapor drying tank 8.

In this apparatus, an article 9 to be cleaned is cleaned with the cleaning solution in the cleaning tank 6. At this time, the cleaning solution is purified by means of a pump P and a filter f to remove dust released in the cleaning solution. The article 9 is then successively transferred to the three rinsing tanks 7 subsequent to the cleaning tank 6 and rinsed with the purging or rinsing solvent in the respective tanks. At this time, the purging or rinsing solvent is purified by means of a pump P and a filter f like the cleaning solution to remove dust released in the rinsing solvent.

The finally-rinsed article (cleaned article) is sent to the vapor drying tank 8 to clean and dry it with vapor 3 vaporized from the nonflammable mixed solvent composition of the present invention. The cleaned article is then taken out of the line.

The vapor 3 is condensed and liquefied by a condenser 1 in the same manner as the cleaning machine illustrated in FIG. 4 to reuse like the embodiment shown in FIG. 4.

The present invention will hereinafter be described more specifically by the following Examples and Comparative Examples. Incidentally, all the designations of "part" or "parts" and "%" as to compositions as will be used in the following examples mean part or parts by weight and % by weight unless expressly noted.

EXAMPLES 1 TO 25 AND COMPARATIVE EXAMPLES 1 TO 8

Mixed solvent compositions according to the present invention and comparative examples, which were composed of their corresponding components shown in Tables 1 and 2, were prepared.

TABLE 1

| | Completely fluorinated organic compound (parts) | Partially fluorinated organic compound (parts) | Unhalogenated organic compound (parts) |
|---|---|---|---|
| Ex. 1 | PF5060 (5) | 1,3-BTFMB*1 (47.5) | Isosol 300 (47.5) |
| Ex. 2 | PF5060 (10) | 1,3-BTFMB*1 (45.0) | Isosol 300 (45.0) |
| Ex. 3 | PF5060 (15) | 1,3-BTFMB*1 (42.5) | Isosol 300 (42.5) |
| Ex. 4 | PF5060 (20) | 1,3-BTFMB*1 (40.0) | Isosol 300 (40.0) |
| Ex. 5 | PF5060 (25) | 1,3-BTFMB*1 (37.5) | Isosol 300 (37.5) |
| Ex. 6 | PF5060 (30) | 1,3-BTFMB*1 (35.0) | Isosol 300 (35.0) |
| Ex. 7 | PF5060 (35) | 1,3-BTFMB*1 (32.5) | Isosol 300 (32.5) |
| Ex. 8 | PF5060 (60) | 1,3-BTFMB*1 (20.0) | Isosol 300 (20.0) |
| Ex. 9 | PF5060 (30) | 1,3-BTFMB*1 (50.0) | Isosol 300 (20.0) |
| Ex. 10 | PF5060 (30) | 1,3-BTFMB*1 (20.0) | Isosol 300 (50.0) |
| Ex. 11 | PF5060 (20) | 1,3-BTFMB*1 (40.0) | Naphthesol LL (40.0) |
| Ex. 12 | PF5060 (30) | 1,3-BTFMB*1 (40.0) | n-Octane (30.0) |
| Ex. 13 | PF5060 (30) | 1,3-BTFMB*1 (40.0) | n-Hexane (30.0) |
| Ex. 14 | PF5060 (30) | 1,3-BTFMB*1 (40.0) | Toluene (30.0) |
| Ex. 15 | PF5060 (20) | 1,4-BTFMB*1 (40.0) | Isosol 300 (40.0) |
| Ex. 16 | PF5060 (20) | 1,4-BTFMB*1 (40.0) | Naphthesol LL (40.0) |
| Ex. 17 | PF5060 (27) | Pentafluoro-benzene (49.0) | Isosol 300 (24.0) |

TABLE 1-continued

| | Completely fluorinated organic compound (parts) | Partially fluorinated organic compound (parts) | Unhalogenated organic compound (parts) |
|---|---|---|---|
| Ex. 18 | PF5060 (25) | Pentafluoro-propanol (57.0) | IPA (18.0) |
| Ex. 19 | KPF-61 (20) | 1,3-BTFMB*1 (40.0) | Isosol 300 (40.0) |
| Ex. 20 | PF5052 (15) | 1,3-BTFMB*1 (45.0) | Isosol 300 (40.0) |
| Ex. 21 | SV90 (40) | 1,3-BTFMB*1 (40.0) | Isosol 300 (20.0) |
| Ex. 22 | PF5070 (40) | 1,3-BTFMB*1 (40.0) | Isosol 300 (20.0) |
| Ex. 23 | PF5060 (50) | 1,3-BTFMB*1 (50.0) | — |
| Ex. 24 | PF5080 (67) | Benzotri-fluoride (33.0) | — |
| Ex. 25 | PF5060 (50) | Ethyl trifluoro-acetate (50.0) | — |

*1: Bis(trifluoromethyl)benzene.

TABLE 2

| | Completely fluorinated organic compound (parts) | Partially fluorinated organic compound (parts) | Unhalogenated organic compound (parts) |
|---|---|---|---|
| Comp. Ex. 1 | PF5060 (100) | — | — |
| Comp. Ex. 2 | — | 1,3-BTFMB*1 (100) | — |
| Comp. Ex. 3 | — | — | Isosol 300 (100) |
| Comp. Ex. 4 | — | 1,3-BTFMB*1 (50) | Isosol 300 (50) |
| Comp. Ex. 5 | Flon 113 (1,1,2-trichloro-1,2,2-trifluoroethane) | | |
| Comp. Ex. 6 | 1,1,1-Trichloroethane | | |
| Comp. Ex. 7 | Methylene chloride | | |
| Comp. Ex. 8 | Flon 141b (1,1-dichloro-1-fluoroethane) | | |

*1: Bis(trifluoromethyl)benzene.

(Note):

PF5060 (perfluorohexane, content>90 wt %), PF5052 ($C_5F_{11}NO$ content>90 wt %), PF5070 (perfluoroheptane, content>90 wt %) and PF5080 (perfluorooctane, content>90 wt %).

Trade names, products of Sumitomo 3M Limited. KPF-61 (perfluorohexane, content>99.5 wt %):

Trade name, product of Kanto Denka Kogyo Co., Ltd. SV90 (100% perfluorohexane, content>99.5 wt %): Trade name, product of Montecatini. Isosol 300 (isoparaffin solvent) and Naphthesol LL (99% saturated hydrocarbon, primarily aliphatic, BP 150–179° C.)

Trade names, products of Nippon Petrochemicals Co., Ltd.

1,3-$C_8F_6H_4$. . . 1,3-Bis(trifluoromethyl)benzene, DS.(F)=6/10=0.6.

1,4-$C_8F_6H_4$. . . 1,4-Bis(trifluoromethyl)benzene, DS.(F)=6/10=0.6.

$C_6F_5H$ . . . Pentafluorobenzene, DS.(F)=5/6=0.833.

$C_3F_5H_3O$ . . . Pentafluoropropanol, DS.(F)=5/8=0.625.

$C_7F_3H_5$. . . Benzotrifluoride, DS.(F)=3/8=0.375.

$C_4F_3H_5O_2$. . . Ethyl trifluoroacetate DS.(F)=3/8=0.375.

Evaluation:

The cleaning solvents obtained in the above examples and comparative examples were evaluated in the following manner. Results obtained are shown in Tables 3 and 4.

Flash Point:

The flash point of each test sample was measured by means of an automatic Tag closed flash point tester (ATG-5 model, manufactured by Tanaka Kagaku Kiki Seisaku K.K.) in accordance with JIS K 2265.

Fire Point:

The fire point of each test sample was measured by means of a Cleveland open-cup flash point tester (manual type) in accordance with JIS K 2265.

Compatibility:

Each composition sample was vigorously shaken at 25° C. and then left at rest for 30 minutes.

ODP:

ODP is an abbreviation of Ozone Depletion Potential.

Phase Separation Temperature:

In order to test the stability of the mixed solvent compositions, each of the solvent compositions according to the examples and comparative examples was put into a 50-ml sample tube equipped with a magnetic stirrer and a thermometer. The sample tube was then immersed in a dry ice-acetone bath to freeze the contents to −78° C. Thereafter, the sample tube was taken out in an atmosphere at room temperature to determine a temperature at which a heterogeneous phase separated due to agitation at about 1,000 rpm by the magnetic stirrer to become opaque turned transparent homogeneous phase. Such a temperature was regarded as a phase separation temperature.

Suitability for Plastics:

In order to confirm that the nonflammable mixed solvent compositions according to the present invention do not have an adverse influence such as dissolution or swelling on commonly-used plastics, a swelling test was conducted. Commonly-used plastics of the following kinds were used as test pieces:

PMMA (acryl): Derpet 80N (trade name, product of Asahi Chemical Industry Co., Ltd.);

PC (polycarbonate): Panlight 1225 (trade name, product of Teijin Chemicals Ltd.);

PS (polystyrene): HT53 (trade name, product of Idemitsu Petrochemical Co., Ltd.); and ABS (acrylonitrile.butadiene.styrene copolymer): Cycolac EX120 (trade name, product of Ube Cycon, Ltd.);

POM (polyacetal): Duracon M90 (trade name, product of Polyplastics Co., Ltd.).

The test was conducted by cutting each test piece into a size of 25×100 (mm), immersing the cut test piece for 1 hour in each mixed solvent composition and then heating the mixed solvent composition to vapor-clean the test piece for 3 minutes. The rate of weight change before and after vapor cleaning was determined to rank the mixed solvent composition in accordance with the following standard:

A: The rate was less than 0.1% by weight;

B: The rate was not less than 0.1% by weight but less than 1% by weight;

C: The rate was not less than 1% by weight.

TABLE 3

| | Flash point (° C.) | Fire point (° C.) | Compatibility | ODP | Phase sepn. temp. (° C.) | Suitability for plastics PMMA | PC | PS | ABS | POM |
|---|---|---|---|---|---|---|---|---|---|---|
| Ex. 1 | None | None | Good | 0 | <−35 | A | A | A | A | A |
| Ex. 2 | None | None | Good | 0 | <−35 | A | A | A | A | A |
| Ex. 3 | None | None | Good | 0 | −33 | A | A | A | A | A |
| Ex. 4 | None | None | Good | 0 | −23 | A | A | A | A | A |
| Ex. 5 | None | None | Good | 0 | −14 | A | A | A | A | A |
| Ex. 6 | None | None | Good | 0 | −5 | A | A | A | A | A |
| Ex. 7 | None | None | Good | 0 | 2 | A | A | A | A | A |
| Ex. 8 | None | None | Good | 0 | 26 | A | A | A | A | A |
| Ex. 9 | None | None | Good | 0 | −32 | A | A | A | A | A |
| Ex. 10 | None | None | Good | 0 | 25 | A | A | A | A | A |
| Ex. 11 | None | None | Good | 0 | −14 | A | A | A | A | A |
| Ex. 12 | None | None | Good | 0 | −20 | A | A | A | A | A |
| Ex. 13 | None | <0 | Good | 0 | <−35 | A | A | A | A | A |
| Ex. 14 | None | None | Good | 0 | 15 | A | A | A | A | A |
| Ex. 15 | None | None | Good | 0 | <−15 | A | A | A | A | A |
| Ex. 16 | None | None | Good | 0 | −10 | A | A | A | A | A |
| Ex. 17 | None | None | Good | 0 | <−35 | A | A | A | A | A |
| Ex. 18 | None | None | Good | 0 | <−35 | A | A | A | A | A |
| Ex. 19 | None | None | Good | 0 | <−35 | A | A | A | A | A |
| Ex. 20 | None | None | Good | 0 | <−35 | A | A | A | A | A |
| Ex. 21 | None | None | Good | 0 | 0 | A | A | A | A | A |
| Ex. 22 | None | None | Good | 0 | −11 | A | A | A | A | A |
| Ex. 23 | None | None | Good | 0 | <−35 | A | A | A | A | A |
| Ex. 24 | None | None | Good | 0 | <−35 | A | A | A | A | A |
| Ex. 25 | None | None | Good | 0 | <−35 | A | A | A | A | A |

TABLE 4

| | Flash point (° C.) | Fire point (° C.) | Compatibility | ODP | Phase sepn. temp. (° C.) | Suitability for plastics PMMA | PC | PS | ABS | POM |
|---|---|---|---|---|---|---|---|---|---|---|
| Comp. Ex. 1 | None | None | — | 0 | N/A | A | A | A | A | A |
| Comp. Ex. 2 | 27 | 62 | — | 0 | N/A | A | A | A | A | A |
| Comp. Ex. 3 | 52 | 58 | — | 0 | N/A | A | A | A | B | A |
| Comp. Ex. 4 | 30 | 46 | Good | 0 | <−35 | A | A | A | A | A |
| Comp. Ex. 5 | None | None | — | 0.8 | N/A | A | A | A | A | A |
| Comp. Ex. 6 | None | None | — | 0.15 | N/A | C | C | C | C | C |
| Comp. Ex. 7 | None | None | — | 0.007 | N/A | C | C | C | C | C |
| Comp. Ex. 8 | None | None | — | 0.08 | N/A | C | C | C | C | C |

EXAMPLE 26

A rust preventing oil (Polybutene LV-7, trade name, product of Nippon Petrochemicals Co., Ltd.) was selected as a model contaminant, and 30 $\mu$l of the rust preventing oil were dropped on a galvanized steel plate (25×76×1 mm, product of Nippon Steel Corporation), thereby providing a model for an article to be cleaned.

Using the mixed solvent composition obtained in Example 4 in all tanks of a cleaning tank, a purging or rinsing tank and a vapor drying tank, a cleaning experiment was conducted on the model by their corresponding cleaning means and under their corresponding cleaning conditions, both, shown in the following Table 5.

TABLE 5

| Kind of tank | Cleaning tank | Purging or rinsing tank | Vapor drying tank |
|---|---|---|---|
| Kind of solution in each tank | PF5060*2/1,3-BTFMB*1/Isosol 300 = 20/40/40 (%) | | |
| Cleaning means | Ultrasonic 28 kHz, 100W | Ultrasonic 28 kHz, 100W | |
| Temperature of solution (° C.) | 40 | 20 | 56 to 60 |
| Cleaning time (min) | 2 | 2 | 2 |

TABLE 5-continued

| Kind of tank | Cleaning tank | Purging or rinsing tank | Vapor drying tank |
|---|---|---|---|
| Amount of solution (ml) | 180 | 180 | 100 |

*1: Bis(trif1uoromethy1)benzene.

Incidentally, 200-ml tall beakers made of Pyrex were used as the cleaning tank and rinsing tank, and the vapor drying tank used was a 500-ml SUS beaker around the upper part of which a cooling coil was arranged trebly. As a cooling liquid, was used water maintained at 20° C.

EXAMPLE 27

Figure 7:
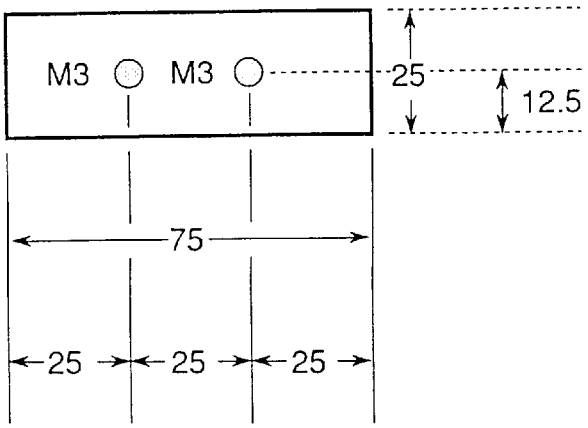
FIG. 7 illustrates a contaminated model article used in embodiments of the present invention.

A metalworking oil (C107 Tapping Oil, trade name, product of Nippon Kosakuyu K.K.) was used as a model contaminant to tap two portions of a bonderized steel plate (25×75×1.5 mm) as illustrated in FIG. 7, thereby providing a model for an article to be cleaned.

A cleaning experiment was performed by means of exactly the same cleaning method and apparatus as in Example 26 except that the mixed solvent composition obtained in Example 11 was used as all of a cleaning solution, a purging or rinsing solution and a vapor drying solvent.

EXAMPLE 28

A paraffin wax (Eprohon C-60, trade name, product of Nippon Kyokuatsu Kagaku Kenkyusho) was selected as a model contaminant, and about 0.5 g of the paraffin wax was applied under heat to a slide glass (25×76×1 mm), thereby providing a model for an article to be cleaned.

Using the above article to be cleaned, a cleaning experiment was conducted by means of a cleaning apparatus composed of one cleaning tank, one purging or rinsing tank and one vapor drying tank by using the mixed solvent composition obtained in Example 17 in the rinsing tank and the vapor drying tank, and Solvesso 200 (trade name, product of Exxon Chemical Japan Ltd.) as a cleaning solvent by their corresponding cleaning means and under their corresponding conditions, both, shown in the following Table 6.

TABLE 6

| Kind of tank | Cleaning tank | Purging or rinsing tank | Vapor drying tank |
|---|---|---|---|
| Kind of solution in each tank | Solvesso 200 | PF5060/pentafluorobenzene/ Isosol 300 = 27/49/24 (%) | |
| Cleaning means | Ultrasonic 28 kHz, 100W | Ultrasonic 28 kHz, 100W | |
| Temperature of solution (° C.) | 65 | 20 | 56 to 60 |
| Cleaning time (min) | 2 | 2 | 2 |
| Amount of solution (ml) | 180 | 180 | 100 |

Incidentally, 200-ml tall beakers made of Pyrex were used as the cleaning tank and rinsing tank, and the vapor drying tank used was a 500-ml SUS beaker around the upper part of which a cooling coil was arranged trebly. As a cooling liquid, was used water maintained at 20° C.

EXAMPLE 29

A paraffin wax (Eprohon C-60, trade name, product of Nippon Kyokuatsu Kagaku Kenkyusho) was selected as a model contaminant, and about 0.5 g of the paraffin wax was applied under heat to a piece (about 5×5×5 mm) of a magnetic head composed of a composite material of Permalloy, an epoxy resin and a zinc die-cast alloy, thereby providing a model for an article to be cleaned.

Using the above article to be cleaned, a cleaning experiment was conducted by means of a cleaning apparatus composed of one cleaning tank, one purging or rinsing tank and one vapor drying tank by using the mixed solvent composition obtained in Example 20 in the rinsing tank and the vapor drying tank, and Clean Sol G (trade name, product of Nippon Oil Co., Ltd.) as a cleaning solvent by their corresponding cleaning means and under their corresponding conditions, both, shown in the following Table 7.

TABLE 7

| Kind of tank | Cleaning tank | Purging or rinsing tank | Vapor drying tank |
|---|---|---|---|
| Kind of solution in each tank | Clean Sol G | PF5052*2/1,3-BTFMB*1/ Isosol 300 = 15/45/40 (%) | |
| Cleaning means | Ultrasonic 28k Hz, 100W | Ultrasonic 28 kHz, 100W | |
| Temperature of solution (° C.) | 65 | 20 | 56 to 60 |
| Cleaning time (min) | 2 | 2 | 2 |
| Amount of solution (ml) | 180 | 180 | 100 |

*1: Bis(trifluoromethyl)benzene.

Incidentally, 200-ml tall beakers made of Pyrex were used as the cleaning tank and rinsing tank, and the vapor drying tank used was a 500-ml SUS beaker around the upper part of which a cooling coil was arranged trebly. As a cooling liquid, was used water maintained at 20° C.

COMPARATIVE EXAMPLE 9

A cleaning experiment was performed by means of exactly the same cleaning method and apparatus as in Example 26 except that the composition obtained in Comparative Example 1 was used in place of the composition obtained in Example 4.

COMPARATIVE EXAMPLE 10

A cleaning experiment was performed by means of exactly the same cleaning method and apparatus as in Comparative Example 9 except that the composition obtained in Comparative Example 7 was used.

COMPARATIVE EXAMPLE 11

A cleaning experiment was performed by means of exactly the same cleaning method and apparatus as in Example 27 except that the composition obtained in Comparative Example 1 was used in place of the composition obtained in Example 11.

COMPARATIVE EXAMPLE 12

A cleaning experiment was performed by means of exactly the same cleaning method and apparatus as in Comparative Example 11 except that the composition obtained in Comparative Example 6 was used.

COMPARATIVE EXAMPLE 13

A cleaning experiment was performed by means of exactly the same cleaning method and apparatus as in Example 28 except that the composition obtained in Comparative Example 1 was used as a rinsing solvent and a vapor drying solvent.

COMPARATIVE EXAMPLE 14

A cleaning experiment was performed by means of exactly the same cleaning method and apparatus as in Comparative Example 13 except that the composition obtained in Comparative Example 5 was used.

COMPARATIVE EXAMPLE 15

A cleaning experiment was performed by means of exactly the same cleaning method and apparatus as in Example 29 except that the composition obtained in Comparative Example 1 was used as a rinsing solvent and a vapor drying solvent.

COMPARATIVE EXAMPLE 16

A cleaning experiment was performed by means of exactly the same cleaning method and apparatus as in Comparative Example 15 except that the composition obtained in Comparative Example 8 was used.

The cleaning ability where the mixed solvent compositions according to the present invention were used as practical cleaning solutions, purging or rinsing solutions and/or vapor drying solvents, was then evaluated by comparing:

Example 26 with Comparative Examples 9 and 10;

Example 27 with Comparative Examples 11 and 12;

Example 28 with Comparative Examples 13 and 14; and

Example 29 with Comparative Examples 15 and 16.

The evaluation was conducted as to contact angle, remaining amount of the contaminant and presence of a stain in accordance with the following respective methods:

Contact Angle:

The contact angle to purified water of a cleaned article on a plate after cleaned according to each of the examples and the comparative examples was measured at room temperature (22 to 25° C.) by means of a full automatic contact angle meter, CA-Z 150 Model manufactured by Kyowa Kaimen-kagaku K.K. The unit is degree [°].

Remaining Amount of Contaminant 1:

The articles cleaned according to the examples and the comparative examples, which the articles had been smeared with the rust preventing oil as a contaminant, were separately immersed in 80 ml of carbon tetrachloride to extract the oil remaining on the articles by means of an ultrasonic cleaner (28 kHz, 100 W). The resultant solutions were subjected to quantitative determination by an oil concentration analyzer (manufactured by Nippon Instruments K.K.) in accordance with an infrared spectroscopic analysis. The unit is μg/article.

Remaining Amount of Contaminant 2:

The articles cleaned according to the examples and the comparative examples, which the articles had been smeared with the paraffin wax as a contaminant, were separately immersed in 100 ml of toluene to extract the wax remaining on the articles by means of an ultrasonic cleaner (28 kHz, 100 W) for 30 minutes at 60° C. The resultant extracts were concentrated to about one-tenth by means of a rotary evaporator, and then subjected to quantitative determination by gas chromatography. The unit is μg/article.

Stain:

The cleaning solvents used in the examples and the comparative examples were ranked as A where no stain remained on the surface of the article cleaned according to each of the examples and the comparative examples, as B where a stain somewhat remained, or C where a stain or oil film remained to a significant extent.

The results are shown in the following Table 8.

TABLE 8

| Ex. | Contact angle [°] | Stain | Remaining amount of conta. [μg/art] | Comp. Ex. | Contact angle [°] | Stain | Remaining amount of conta. [μg/art] |
|---|---|---|---|---|---|---|---|
| 26 | 5 | A | 0.4 | 9 | 27 | C | 10 |
| | | | | 10 | <5 | A | 0.4 |
| 27 | <5 | A | — | 11 | 36 | C | — |
| | | | | 12 | <5 | A | — |
| 28 | <5 | A | — | 13 | 42 | C | — |
| | | | | 14 | <5 | A | — |
| 29 | — | A | 10 | 15 | — | B | 40 |
| | | | | 16 | — | B | 10 |

In Table 8, the remaining amounts of the contaminant in Examples 28 and 29, and Comparative Examples 13 to 16 are values obtained in accordance with the measuring method 2 for the remaining amount of the contaminant.

As described above, the nonflammable mixed solvent compositions according to the present invention are useful as replacements for organochlorine solvents including flons and triethane. Besides, they contain no chlorine atom and hence have no ozone depletion potential, and moreover have no flash point owing to their well-balanced compositions. Further, the nonflammable mixed solvent compositions according to the present invention scarcely have an adverse influence such as swelling on various kinds of plastic materials and can hence be satisfactorily put to good use as not only various cleaning solvents for metals including vapor cleaning solvents, but also diluents, dispersing media and the like.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded to the broadest interpretation so as to encompass all such modifications and equivalent structures and functions.

What is claimed is:

1. A nonflammable mixed solvent composition comprising 5 to 35% by weight of a completely fluorinated organic compound selected from the group consisting of perfluoropentane, perfluorohexane and perfluoroheptane, 20 to 65% by weight of a partially fluorinated aromatic organic compound, wherein said partially fluorinated aromatic organic compound contains no halogen atom other than fluorine, and 18 to 47.5% by weight of an unhalogenated hydrocarbon compound.

2. The nonflammable mixed solvent composition according to claim 1, wherein the composition satisfies a relationship of (weight fraction of the partially fluorinated organic compound)≧(weight fraction of the unhalogenated organic compound).

3. The nonflammable mixed solvent composition according to any one of claims 1 or 2, wherein the completely fluorinated organic compound has a vapor pressure of 5.33 kPa or higher at 25° C.

4. The nonflammable mixed solvent composition according to any one of claims 1 or 2, wherein the partially fluorinated organic compound has a boiling point not lower than 60° C. but lower than 120° C.

5. The nonflammable mixed solvent composition according to any one of claims 1 or 2, wherein the molecular formula of the partially fluorinated organic compound is represented by $C_aH_bF_cX_d$, in which X is a heteroatom as a constituent for the organic compound selected from the group consisting of O, N, S, P and Si, a, b and c are independently a natural number, and d is an integer not smaller than 0, and the degree of substitution by fluorine is indicated by [DS.(F)], and the partially fluorinated organic compound satisfies the following relationship:

$$DS.(F)=c/(b+c)$$

$$0.85 \geqq DS.(F) \geqq 0.35.$$

6. The nonflammable mixed solvent composition according to claims 1 or 2, wherein the unhalogenated organic hydrocarbon has a flash point not lower than 0° C. but lower than 70° C.

7. The nonflammable mixed solvent composition according to claim 1 or 2, wherein the completely fluorinated organic compound is perfluoro-hexane, the partially fluorinated organic compound is 1,3-bis(trifluoromethyl)benzene, 1,4-bis(trifluoromethyl)benzene or a mixture thereof, and the unhalogenated organic hydrocarbon is an isoparaffin or naphthene having a flash point not lower than 25° C. but lower than 60° C.

8. The nonflammable mixed solvent composition according to any one of claims 1 or 2, wherein the partially fluorinated organic compound is at least one compound selected from the group consisting of 1,3-bis(trifluoromethyl)benzene, 1,4-bis(trifluoromethyl)benzene, benzotrifluoride and pentafluorobenzene.

* * * * *

UNITED STATES PATENT AND TRADEMARK OFFICE

CERTIFICATE OF CORRECTION

PATENT NO. : 5,968,882

DATED : October 19, 1999

INVENTOR(S) : HIROHIDE MATSUHISA, ET AL.

It is certified that error appears in the above-identified patent and that said Letters Patent is hereby corrected as shown below:

Title page, item [56], References Cited

FOREIGN PATENT DOCUMENTS

Line 3, "05214324" should read --5-214324--; and

Line 5, "7048563 2/1995 Japan" should be deleted.

COLUMN 2

Line 46, "proper one" should read --a proper one--.

COLUMN 8

Line 13, "[PF5060perfluorohexane/" should read --[PF5060 perfluorohexane/--; and Line 28, "[PF5060perfluorohexane/" should read --[PF5060 perfluorohexane/--.

UNITED STATES PATENT AND TRADEMARK OFFICE

CERTIFICATE OF CORRECTION

PATENT NO. : 5,968,882

DATED : October 19, 1999

INVENTOR(S) : HIROHIDE MATSUHISA, ET AL.

It is certified that error appears in the above-identified patent and that said Letters Patent is hereby corrected as shown below:

COLUMN 11

Line 52, "perfluorohexane, content>99.5 wt %:" should read --perfluoroether),--; and Line 61, "0.6." (i.e., in boldface print) should read --0.6.-- (i.e., should not be in boldface print).

COLUMN 15

Line 9, Table 5, below "*1: Bis(trifluoromethyl)benzene." insert --*2: perfluorohexane.--

COLUMN 16

Line 22, Table 7, second column, "28k Hz" should read --28 kHz--; and

UNITED STATES PATENT AND TRADEMARK OFFICE

CERTIFICATE OF CORRECTION

PATENT NO. : 5,968,882

DATED : October 19, 1999

INVENTOR(S) : HIROHIDE MATSUHISA, ET AL.

It is certified that error appears in the above-identified patent and that said Letters Patent is hereby corrected as shown below:

COLUMN 16

Line 30, Table 7, below "*1: Bis(trifluoromethyl)benzene."

insert --*2: $C_5 F_{11} N_0$, content > 90 wt %.--.

COLUMN 17

Line 38, "after cleaned" should read --after being cleaned--;

Line 45, "the" should be deleted; and

Line 56, "the" should be deleted.

COLUMN 18

Line 11, Table 8, second column, "5" should read --<5--.

UNITED STATES PATENT AND TRADEMARK OFFICE

CERTIFICATE OF CORRECTION

PATENT NO. : 5,968,882

DATED : October 19, 1999

INVENTOR(S) : HIROHIDE MATSUHISA, ET AL.

It is certified that error appears in the above-identified patent and that said Letters Patent is hereby corrected as shown below:

COLUMN 19

Lines 11 to 12, "DS.(F)=c/(b+c)

0.85≥DS.(F)≥0.35."

should read --DS.(F)=c/(b+c)

0.85≥DS.(F)≥0.35.--.

Signed and Sealed this

Second Day of January, 2001

*Attest:*

*Attesting Officer*

Q. TODD DICKINSON

*Commissioner of Patents and Trademarks*